US006003734A

United States Patent [19]

Oh

[11] Patent Number: 6,003,734

[45] Date of Patent: Dec. 21, 1999

[54] WATER DISPENSER OF REFRIGERATOR

[75] Inventor: Jae-Sek Oh, Kyungki-do, Rep. of Korea

[73] Assignee: Samsung Electronics Co., Ltd., Suwon, Rep. of Korea

[21] Appl. No.: 08/983,501

[22] PCT Filed: Jul. 24, 1996

[86] PCT No.: PCT/KR96/00116

§ 371 Date: Mar. 9, 1998

§ 102(e) Date: Mar. 9, 1998

[87] PCT Pub. No.: WO97/05436

PCT Pub. Date: Feb. 13, 1997

[30] Foreign Application Priority Data

| | | | |
|---|---|---|---|
| Jul. 26, 1995 | [KR] | Rep. of Korea | 95-18722 U |
| Jul. 26, 1995 | [KR] | Rep. of Korea | 95-18723 U |
| Jul. 26, 1995 | [KR] | Rep. of Korea | 95-18724 U |
| Aug. 18, 1995 | [KR] | Rep. of Korea | 95-25467 |
| Jul. 3, 1996 | [KR] | Rep. of Korea | 96-26839 |

[51] Int. Cl.[6] ..... B67D 5/62

[52] U.S. Cl. ..... 222/146.6; 222/189.09; 222/190; 222/504; 222/507; 222/518; 222/547; 251/65; 141/DIG. 1; 141/351; 141/357

[58] Field of Search ..... 251/65; 222/189.09, 222/146.6, 547, 190, 482, 504, 507, 509, 518; 141/DIG. 1, 351, 352, 357, 362

[56] References Cited

U.S. PATENT DOCUMENTS

| | | | |
|---|---|---|---|
| 429,121 | 6/1890 | Engquist | 222/509 X |
| 2,777,304 | 1/1957 | Nave | 222/146.6 X |
| 2,781,153 | 2/1957 | Roberts | 222/146.6 X |
| 3,609,425 | 9/1971 | Sheridan | 251/65 X |
| 3,934,757 | 1/1976 | Malek . | |
| 4,011,969 | 3/1977 | Martin | 222/504 X |
| 4,161,971 | 7/1979 | Arzberger . | |
| 4,624,395 | 11/1986 | Baron et al. | 222/504 X |
| 4,651,789 | 3/1987 | Linstromberg . | |
| 4,662,271 | 5/1987 | Woltermann | 251/65 X |
| 5,683,015 | 11/1997 | Lee | 222/146.6 |
| 5,791,523 | 8/1998 | Oh | 222/146.6 |
| 5,819,547 | 10/1998 | Oh | 141/DIG. 1 X |

*Primary Examiner*—Kenneth Bomberg

*Attorney, Agent, or Firm*—Burns, Doane, Swecker & Mathis, L.L.P.

[57] ABSTRACT

A refrigerator has a cold water storage vessel mounted on an interior side of a door of the refrigerator. The vessel has a valve for opening and closing a water outlet thereof. A manually actuable lever mounted on the door is actuable by a user to discharge water. By actuating the lever, a magnetic force causes the valve to open. The magnetic force can be imposed by a first permanent magnet which is caused to approach a second permanent magnet disposed on the valve to repel the second magnet and thereby open the valve. Alternatively, a permanent magnet disposed on the valve can be repelled by a magnetic force of a stationary electromagnet which is energized by actuation of the lever.

22 Claims, 13 Drawing Sheets

WATER DISPENSER OF REFRIGERATOR

BACKGROUND OF THE INVENTION

1. Field of the Invention

The present invention relates to a water dispenser constructed in such way as to enable dispensation of cold water(drinking water) stored in a refrigerator at an external side of the refrigerator without opening and closing a door thereof.

2. Description of the Prior Art

A typically-used water dispenser of a refrigerator is constructed, as illustrated in FIG. 1, to dispense cold water stored in the refrigerator at an external side of a refrigerator body 1, to which a freezing chamber door 2 and a refrigerating chamber door 3 are coupled by a hinge (not shown) in such way as to allow the doors 2 and 3 to be opened and closed freely.

The refrigerating chamber door 3 is disposed at one side thereof with a water dispenser 4.

As illustrated in FIG. 2, the water dispenser 4 is releasably disposed at an inner side of the refrigerating chamber door 3 with a water storage vessel 9 where cold water (w) is stored.

Furthermore, the water storage vessel 9 is disposed at an upper side thereof with a lid 10 in such way as to allow same to be opened and closed, and mounted at a lower side thereof with a lower cap 11.

The lower cap 11 is resiliently provided at an inner side thereof with a valve body 12 by a spring 8*b* so as to be vertically moved by a slide member 7.

The valve body 12 is arranged at an upper end thereof with a valve plate 13 for controlling flow of the cold water(w) by opening and closing an upper end of the lower cap 11 according to the vertical movement of the valve body 12.

Meanwhile, the refrigerating chamber door 3 is formed at an inner side thereof with a water discharge outlet 5*a* to allow the cold water(w) to be discharged out of the water storage vessel 9, and lengthwise and piercingly disposed at an upper side thereof with a cylinder 5 formed with a mounting part 5*b* thereon.

The cylinder 5 is provided therein with the slide member 7 resiliently disposed by a spring 8, where the slide member 7 is connected to a rod 7*a* and horizontally and sliding operated by operation of a water discharge lever 6 hingedly coupled to a front side thereof.

The mounting part 5*b* is mounted therein with the water storage vessel 9.

Now, an operational relation of the water dispenser of the conventional refrigerator thus constructed will be described.

First of all, when the water storage vessel 9 where a predetermined quantity of cold water (w) is stored is placed in the mounting part 5*b* formed at an upper side of the cylinder 5, the valve body 12 coupled to an inner side of the lower cap 11 is lifted downward at a lower end thereof by elastic force of the spring 8*a* to thereby cause the valve plate 13 to close an upper end of the lower cap 11, so that the cold water (w) in the water storage vessel 9 can maintain a state of not being discharged, as illustrated in FIG. 2.

When a vessel (c) such as cup and the like is placed underneath the water discharge outlet 5*a* as illustrated in FIG. 2 in an alternate long and short dash line, and when the vessel (c) is pushed toward an arrow direction, the water discharge lever 6 is forwardly moved.

According to the forward operation of the water discharge lever 6, the slide member 7 connected to the rod 7*a* is backwardly moved and at the same time, the valve body 12 is upwardly operated.

Accordingly, the valve plate 13 coupled to the upper end of the valve body 12 is lifted upward to thereby open an upper end of the lower cap 11, so that the cold water (w) can be discharged into the vessel (c) through the lower cap 11, cylinder 5 and through the water discharge outlet 5*a*.

However, there is a problem in the conventional water dispenser in that same is made by numerous parts, making it difficult to be assembled and thereby increasing manufacturing cost.

There is another problem in that a cylinder and a slide member have to be separated for cleaning thereof, thereby causing lots of inconveniences,

SUMMARY OF THE INVENTION

Accordingly, it is an object of the present invention to provide a water dispenser of a refrigerator having a simple construction for easy assembly and dismantlement.

It is another object of the present invention to provide a water dispenser of a refrigerator for magnetizing cold water discharged from a water storage vessel to thereby provide magnetized water good for the health.

It is still another object of the present invention to provide a water dispenser of a refrigerator for moving an operational axis accurately by utilizing a plurality of magnetic members or electromagnets, thereby preventing water from being leaked out of a valve plate and a cold water passage.

It is a still further object of the present invention to provide a water dispenser of a refrigerator for utilizing magnetization means connected to electrically-contacted manipulating means, to thereby allow the cold water stored in a water storage vessel to be dispensed at an external side of the refrigerator.

In accordance with one object of the present invention, there is provided a water dispenser of a refrigerator, the dispenser including a cylinder for being piercingly disposed at one side of a refrigerating chamber door and for being disposed with a mounting part formed at one side thereof, a water storage vessel for being accommodated at an inner side of the mounting part to thereby store cold water therein and a water discharge lever hingecoupled to a front surface of the cylinder, comprising:

a slide member for being disposed at an inner side of the cylinder and having a first magnetic member at one side thereof; and an operational axis for being insertedly disposed in a lower cap of the water storage vessel for vertical movement and for being disposed at one side thereof with a second magnetic member, so that the first magnetic member approaches the second magnetic member according to operation of the water discharge lever to thereby raise the operational axis for discharge of the cold water.

In accordance with another object of the present invention, there is provided a water dispenser of a refrigerator, the dispenser comprising;

a water storage vessel for being placed at a mounting part formed at an inner side of the refrigerating chamber door and for being disposed with a lid having an air hole at an upper side thereof for opening and closing thereof and a lower cap releasably disposed at one side thereunder;

a first magnetic member for being fixed to a water discharge lever internally formed at a guide member; and valve means for opening a valve plate according to magnetic force generated at the first magnetic member to thereby cause the cold water stored in the water storage vessel to be selectively discharged.

In accordance with a further object of the present invention, there is provided a water dispenser of a refrigerator, the dispenser comprising;

a water storage vessel for being comfortably placed at a mounting part formed at an inner side of the refrigerating chamber door and for being disposed at an upper side thereof with a lid having an air hole thereon at an upper side thereof for opening and closing thereof and a lower cap for being releasably disposed at one side thereunder;

a water discharge cap for being releasably coupled to the lower cap of the water storage vessel and for having a water discharge outlet at a lower side thereof;

a first magnetic member for being fixed to a water discharge lever internally formed at a cover; and valve means for having a second magnetic member for opening a valve plate by the magnetic force generated from the first magnetic member to thereby cause the cold water stored in the water storage vessel to be selectively discharged.

In accordance with still further object of the present invention, there is provide a water dispenser of a refrigerator, the dispenser comprising:

a water storage vessel for being comfortably disposed at a mounting part formed at an inner side of the refrigerating chamber door;

an operational axis for being connected at one side thereof to a valve plate and connected at the other side thereof to a second magnetic member;

valve means having a cold water pipe for guiding flow of the cold water;

magnetization means for being disposed at one side of the refrigerating chamber door; and manipulating means for being electrically connected to the magnetization means and for being disposed in a case guide groove.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Embodiments of the present invention will now be described in detail with reference to the accompanying drawings.

Figure 1:
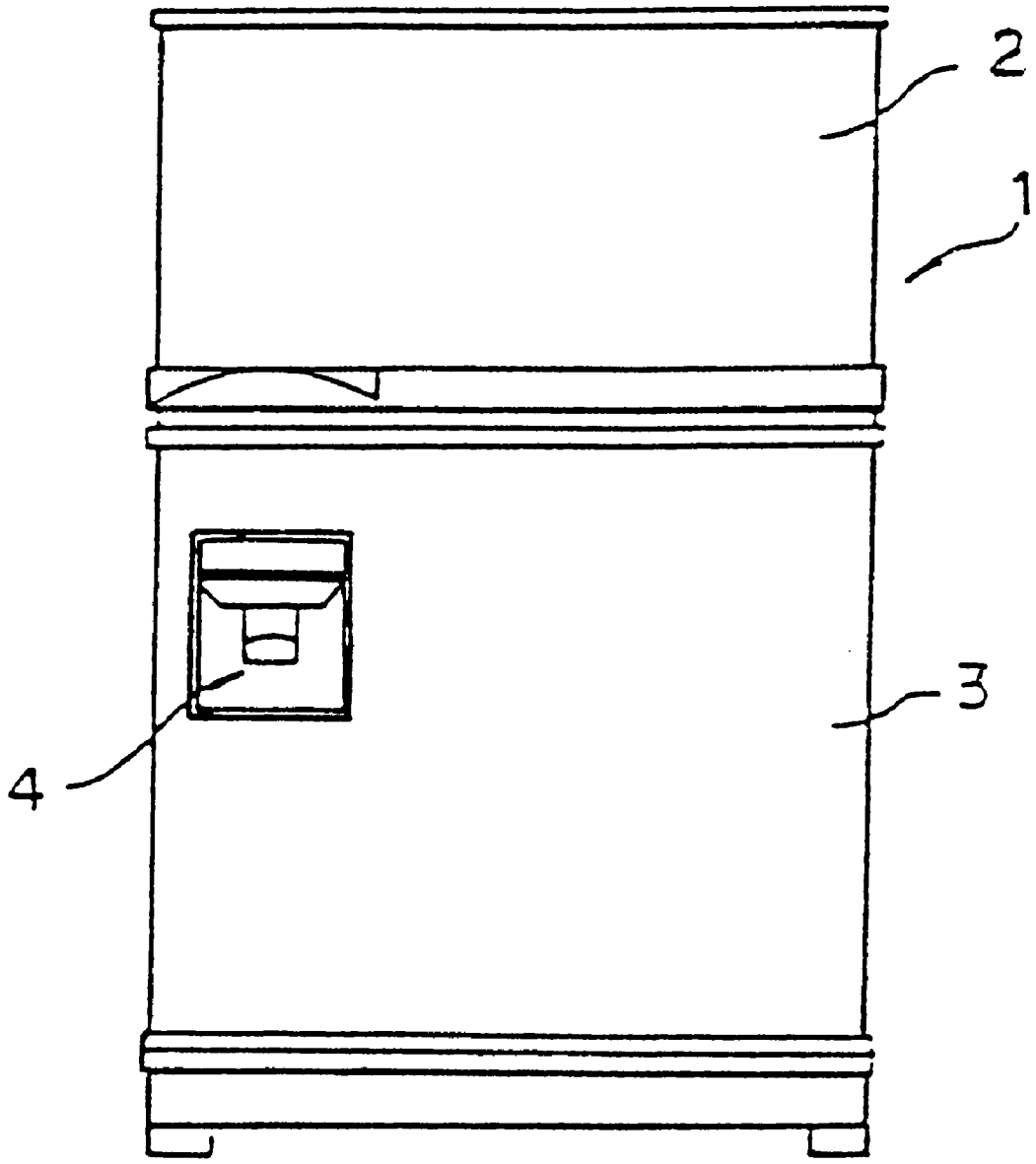
FIG. 1 (PRIOR ART)
FIG. 1 is a schematic sectional view for illustrating a refrigerator applied by a conventional water dispenser.
Figure 2:
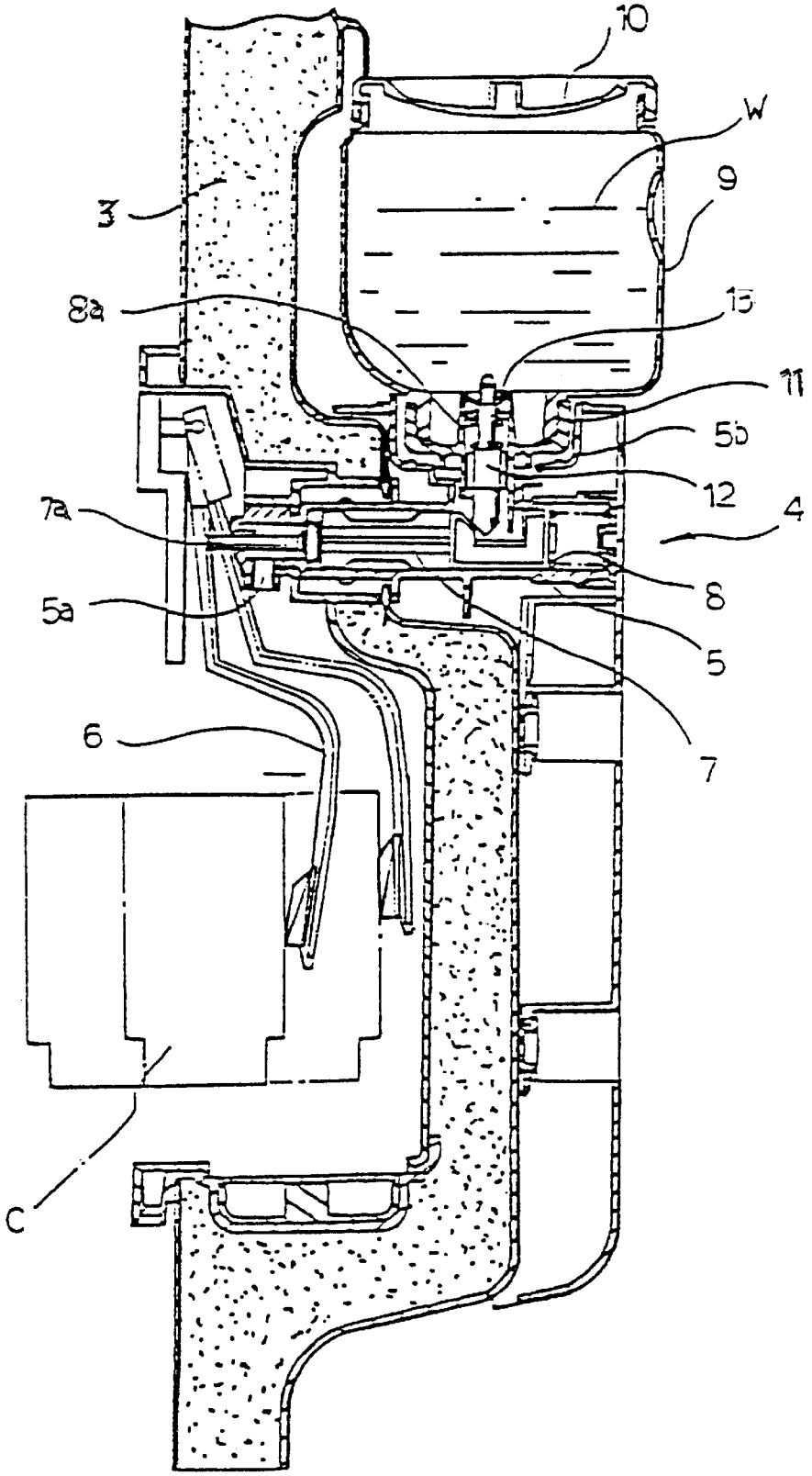
FIG. 2 (PRIOR ART)
FIG. 2 is a sectional view for illustrating an enlarged conventional water dispenser.
Figure 3:
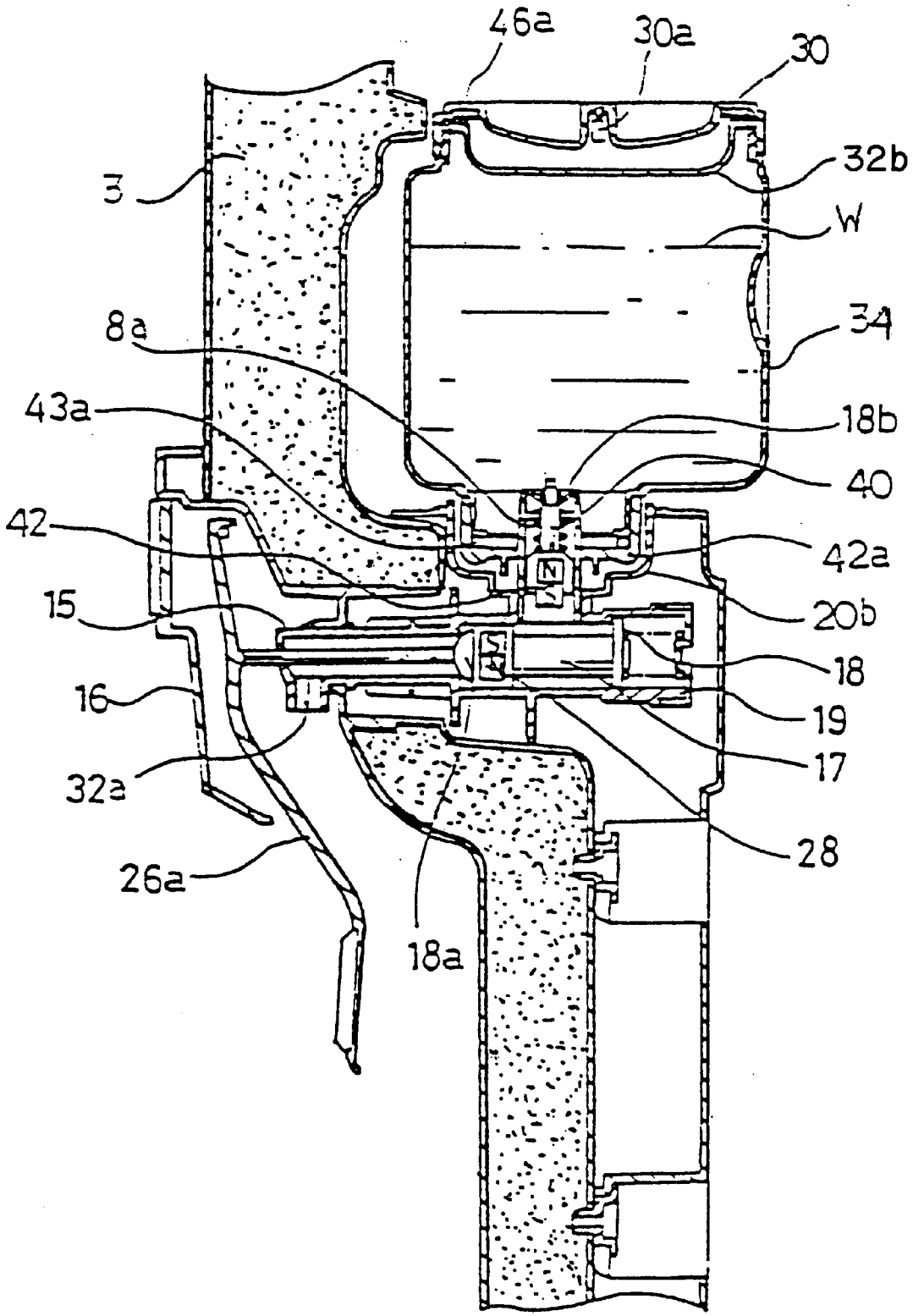
FIG. 3 is an assembled sectional view of a water dispenser of a refrigerator according to a first embodiment of the present invention.

FIG. 3 is an assembled sectional view of a water dispenser of a refrigerator according to a first embodiment of the present invention.

Reference number 15 in FIG. 3 is a cylinder for being pierced through one side of the refrigerating chamber door 3 to be mounted tightly and insertedly thereat, and the cylinder 15 is formed at a tip end thereof with a water discharge outlet 32*a* for discharging cold water (W).

The cylinder 15 is resiliently disposed therein with a slide member 17 by a resilient member 18, and the slide member 17 is resiliently contacted at a tip end thereof to an inner side of a water discharge lever 26*a* hinge-coupled to a front surface of the refrigerating chamber door 3 for being rotated.

The slide member 17 is fixedly provided with a first valve plate, 18*a* for selectively opening and closing an inner side of the cylinder 15 according to a slide operation caused by an operation of the water discharge lever 26*a*, where the first valve plate 18*a* is insertedly disposed at one side thereof with a first magnetic member 28.

Furthermore, the cylinder 15 is screwed at an inner end thereof by a plug 19 to allow the slide member 17 and the resilient member 18 to be separated therefrom.

Meanwhile, a mounting part 20*b* formed at an upper side of the cylinder 15 is releasably disposed with a water storage vessel 34 for storing a predetermined quantity of cold water (W) therein.

The water storage vessel 34 is formed at an upper side thereof with an air hole 30*a* for air ventilation and at the same time is coupled at a predetermined spacing to a lid 30 for separation therefrom through the medium of a filter member 32*b*.

The water storage vessel 34 is separably coupled at a lower side thereof to a lower cap 42*a* for being resiliently disposed with an operational shaft 40 vertically operated according to operation of the slide member 17.

The operational shaft 40 is resiliently disposed through the medium of a resilient member 8*a* at an inner side of the lower cap 42*a*.

The operational shaft 40 is fixedly arranged at an upper side thereof with a second valve plate 18*b* for selectively opening and closing an upper end of the lower cap 42*a* to thereby allow the cold water (W) in the water storage vessel 34 to flow into the lower cap 42*a*.

Furthermore, the operational shaft 40 is fixedly mounted at a lower side thereof with a second magnetic member 42 for raising the operational shaft 40 by way of magnetic force generated from the first magnetic member 30.

The operational shaft 40 is so constructed as to prevent a lower end thereof from protruding from a lower end tip of the lower cap 42*a*, and the first and second magnetic members 28 and 42 are so constructed as to cause the operational shaft 40 to be raised when magnetic poles of the same polarity approach.

Unexplained reference numeral 16 in the drawing indicates a cover plate coupled to a front surface of the refrigerating chamber door 3, and reference numeral 43*a* represents a packing member for preventing leakage of the cold water (W) by being disposed between the water storage vessel 34 and the lower cap 42*a*.

Reference numeral 46*a* defines another packing member for preventing leakage of the cold water (W).

Now, an operational effect of the water dispenser of a refrigerator according to the first embodiment of the present invention thus constructed will be described.

First of all, a predetermined quantity of cold water (W) is stored in the water storage vessel 34 under a state where the lid 30 is separated. Then, the water storage vessel 34 combined with the lid 30 is mounted into the mounting part 20*b* formed at an upper side of the cylinder 15.

Figure 4:
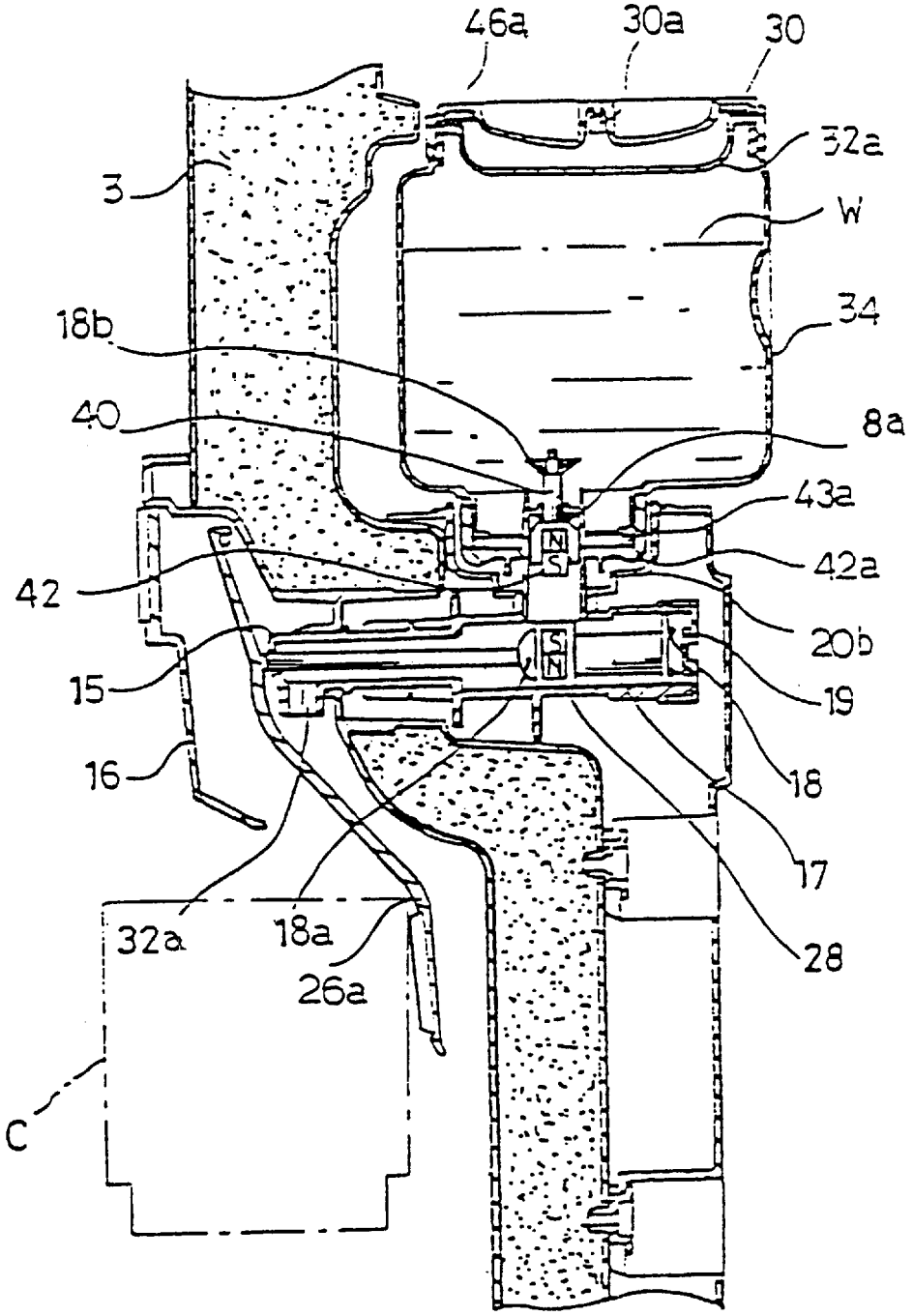
FIG. 4 is a sectional view for illustrating an operational state of the water dispenser illustrated in FIG. 3.

At this time, when a vessel (C) such as a cup and the like is placed against the water discharge lever 26*a* and when force is applied thereto as illustrated in FIG. 4, the slide member 17 serves to compress the resilient member 18 to thereafter be retreated, and at the same time, the first valve plate 18*a* is moved to open an inner side of the cylinder 15 and to raise the operational shaft 40 resiliently disposed in an inner side of the lower cap 42*a*.

In other words, the first magnetic member 28 which slides along the retreat operation of the slide member 17 approaches a lower side of the second magnetic member 42, so that repulsive force is worked by the magnetic poles of the same polarity between the first and second magnetic members 28 and 42, whereby the operational shaft 40 is raised up by the repulsive force.

Accordingly, the operational shaft 40 serves to compress the resilient member 18 and is raised up, so that the second valve plate 18*b* is detached from an upper end of the lower up 42*a* to thereby allow the cold water (W) to be infused into the lower cap 42*a*.

The cold water (W) infused into the lower cap 42*a* is discharged into the vessel (C) through the cylinder 15 and the water discharge outlet 32*a* to thereby allow the cold water (W) to be dispensed.

At this time, the cold water (W) discharged into the water discharge outlet 32*a* is magnetized by the first and the second magnetic members 28 and 42 when same is infused into the lower cap 42*a* and the cylinder 15, thereby enabling hexagonal water to be obtained having a hexagonal ring structure which is good for the human body.

Meanwhile, when the force applied to the water discharge lever 26 is released, the slide member 17 is forwardly moved by the elastic force of the resilient member 18, and simultaneously the first valve plate 18*a* serves to block an inner passage of the cylinder 15 to thereby be stopped supply of the cold water (W).

Furthermore, the repulsive force generated by the magnetic force from the first and the second magnetic members 28 and 42 is lost when same returns to an original state, as illustrated in FIG. 3, and the operational shaft 40 is moved downward by the elastic force of the resilient member 8*a*.

Therefore, the second valve plate 18*b* serves to close an upper end of the lower cap 42*a* to thereby cause the cold water (W) in the water storage vessel 34 to be discharged no longer. Accordingly, once the discharge of the cold water (W) is completed, the cold water (W) is avoided from being supplied into the cylinder 15 by the first valve plate 18*a*. The cold water (W) is also prevented from being supplied to the lower cap 42*a* by the second valve plate 18*b*, so that the force applied to the water discharge lever 26*a* is released and at the same time, discharge of the cold water (W) is stopped to thereby enable a minimized generation of residual water.

Furthermore, if the cold water (W) is to be supplemented in the water storage vessel 34, the vessel 34 is separated from the mounting part 20*b* and the lid 30 is separated, which enables replenishment of the cold water (W).

As mentioned in the foregoing, there is an advantage in the water dispenser of a refrigerator according to the first embodiment of the present invention, in that cold water can be selectively discharged from a water storage vessel by way of first and second magnetic members, thereby making same in a simpler structure than that of the conventional water dispenser.

There is another advantage in that the cold water can be magnetized by the magnetic force from the first and second magnetic members, thereby enabling to obtain magnetization water useful for the human body.

Figure 5:
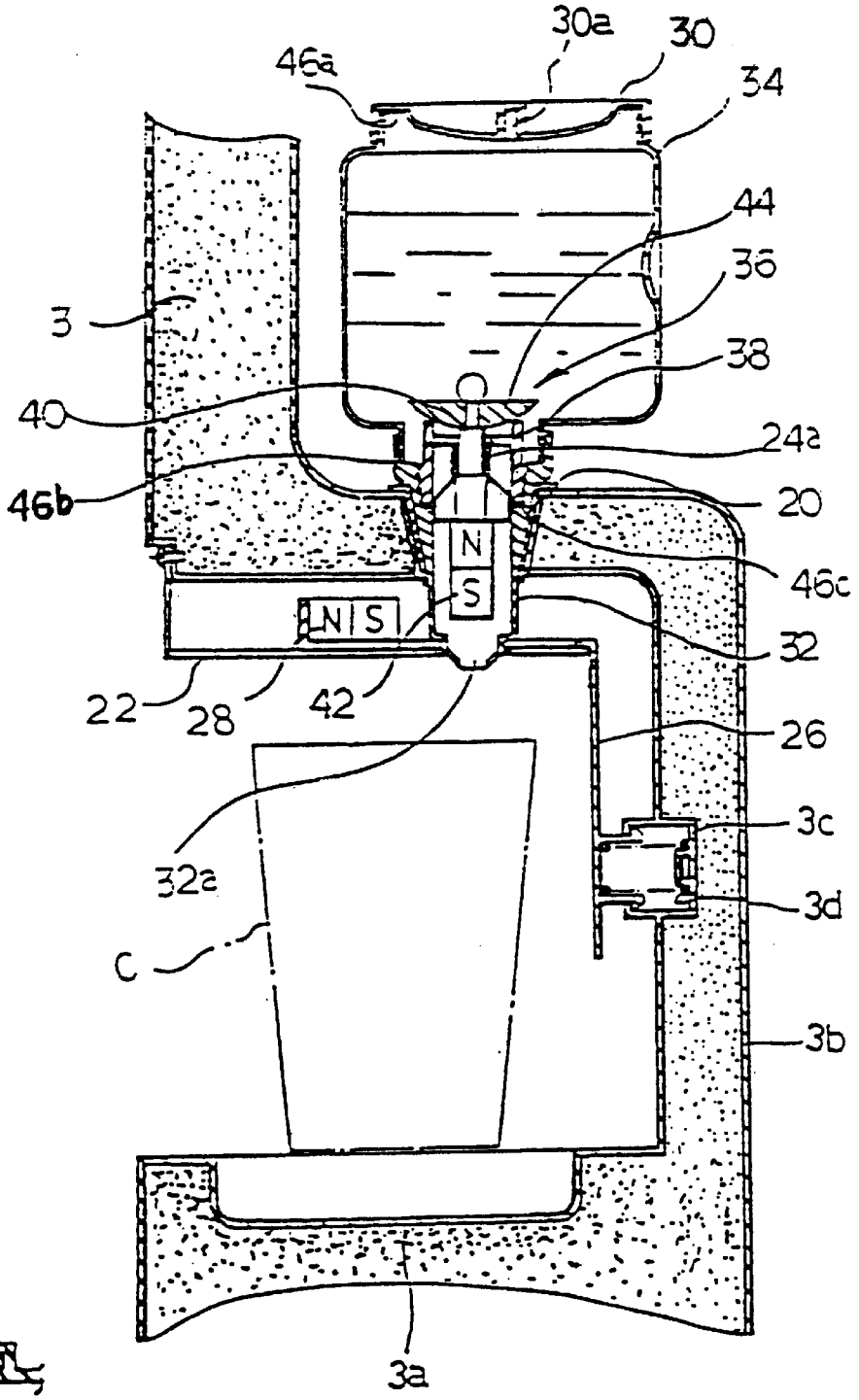
FIG. 5 is an assembled sectional view for illustrating a water dispenser of a refrigerator according to a second embodiment of the present invention.

FIG. 5 is a sectional view for illustrating a water dispenser of a refrigerator according to a second embodiment of the present invention.

As illustrated in FIG. 5, the refrigerating chamber door 3 is formed at an inner side thereof with a panel 3*b* and at an external side thereof with a case 3*a*.

The refrigerating chamber door 3 is also disposed at an inner side thereof with a mounting member 20.

The mounting member 20 is fixedly fastened at a lower side thereof to a guide member 22 at a predetermined spacing from the case 3*a*.

The guide member 22 is invertedly disposed at one end thereof with a water discharge lever 26 for horizontal sliding, where the lever 26 is resiliently arranged by a spring 3*d* in a case guide groove 3*c* formed at one side of the case 3*a*.

The lever 26 is insertedly and horizontally fixed at an upper side thereof, that is, at an inner side of the guide member 22 to the first magnetic member 28.

Figure 6:
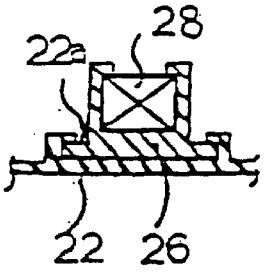
FIG. 6 is a sectional view for illustrating a connected relation between a first magnetic member and a water discharge lever as principal parts of the second embodiment of the present invention.

The water discharge lever 26 is constructed such that, as illustrated in FIG. 6, both ends thereof can be insertedly disposed to enable same to slide into a guide groove 22*a* formed at the guide member 22.

Meanwhile, the mounting unit 20 is disposed at an upper side thereof with the water storage vessel 34. The water storage vessel 34 is provided at an upper side thereof with the lid 30 formed with the air hole 30*a* thereof for air ventilation therethrough, and at a lower side thereof with a lower cap 32 having a water discharge outlet 32*a* for discharging the cold water (W) stored in the water storage vessel 34.

Furthermore, the lower cap 32 is coupled therein to valve means 36 for selectively discharging the cold water (W) stored in the water storage vessel 34 according to operation of the water discharge lever 26.

The valve means 36 includes a cold water pipe 38 screwed to an inner side of the lower cap 32 and the operational shaft 40 resiliently disposed by resilient member 24*a* at an inner side of the cold water pipe 38.

The operational shaft 40 is fixedly disposed at an upper end thereof with a valve plate 44 for opening and closing the cold water pipe 38 to thereby control supply of the cold water (W), and is lengthwise and fixedly disposed at a lower end thereof with the second magnetic member 42 having a magnetic pole of polarity opposite to that of the first magnetic member 38.

Unexplained reference numerals 46*a*, 46*b* and 46*c* in FIG. 5 are packing members for preventing leakage of the cold water (W).

Next, an operational effect of the water dispenser of a refrigerator according to the second embodiment of the present invention thus constructed will be described.

When the water storage vessel 34 storing a predetermined quantity of cold water (W) is mounted to the mounting member 20 formed at one side of the refrigerating chamber door 3, the valve means 36 is closed to thereby prevent the cold water (W) in the water storage vessel 34 from being discharged.

In other words, the operational shaft 40 of the valve means 36 is activated downward by water pressure of the water storage vessel 34 and the elastic force of the elastic member 24*a* to thereby cause the valve plate 44 to close an upper end of the cold water pipe 38, so that the water discharge outlet 32*a* can maintain a close state.

Figure 7:
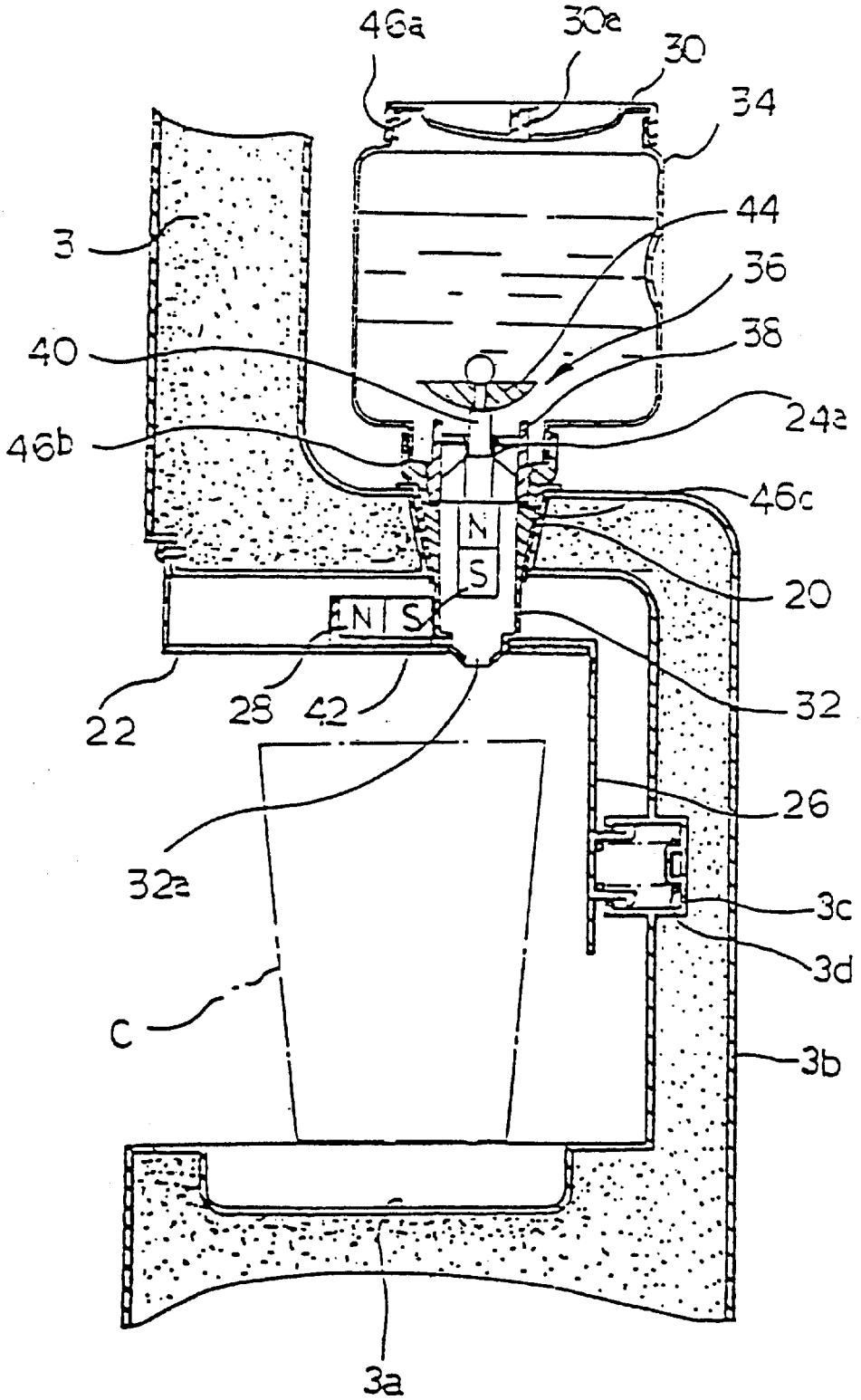
FIG. 7 is a sectional view for illustrating an operational state of the water dispenser illustrated in FIG. 5.

At this time, when the vessel (C) is pushed to thereby apply force to the water discharge lever 26 under a state where the vessel (C) such as cup and the like is placed underneath the water discharge outlet 32*a*, the water discharge lever 26 slides and opens the valve means 36 to thereby discharge the cold water (W), as illustrated in FIG. 7.

In other words, when the water discharge lever 26 starts to compress the elastic member 24 for advance movement, as illustrated in FIG. 7, the first magnetic member 28 moves to approach the lower cap 32 and simultaneously, the second magnetic member 42 is repulsed by the magnetic force generated by the first magnetic member 28 to thereby raise the operational shaft 40.

At this time, the polarities of the first and second magnetic members 28 and 42 are the same and are designed to face each other.

When the operational shaft 40 compresses the resilient member 24*a* to thereafter be raised, the valve plate 44 formed at an upper end thereof is detached from the cold water pipe 38 to thereby allow the cold water (W) to be infused into the cold water pipe 38.

The cold water (W) infused into the cold water pipe 38 is discharged into the vessel (C) through the lower cap 32 and the water discharge outlet 32*a*, thus enabling the water discharge.

The cold water (W) discharged into the water discharge outlet 32*a* is magnetized by the magnetic force generated from the first and the second magnetic members 28 and 42, and at the same time, a ring structure of the water is changed to hexagonal ring structure, that is changed to magnetization water, which is good for the health.

Meanwhile, when the force applied to the water discharge lever 26 is released, the water discharge lever 26 is returned to an original position by the elastic force of the elastic member 24, as illustrated in FIG. 5, and at the same time the first magnetic member 28 is detached from the lower cap 32 to thereby lose the magnetic force working on the second magnetic member 42.

The operational shaft 40 is therefore activated downward by the elastic force of the elastic member 24*a* and at the same time, the valve plate 44 is lowered to thereby close an upper end of the cold water pipe 38, so that the cold water (W) is stopped of its discharge.

Meanwhile, when the water dispenser is to be cleaned, the water storage vessel 34 is detached from the mounting member 20.

After the water storage vessel 34 is detached from the mounting member 20, and then the lower cap 32, cold water pipe 38 and the operational shaft 40 are sequentially separated and cleaned. After the cleaning thereof is finished parts are assembled in the reverse order as against the detachment thereof, which is very simple.

As mentioned in the above, there is an advantage in the water dispenser of a refrigerator according to the second embodiment of the present invention thus constructed, in that structure thereof is simple for easy dismantlement and assembly, and at the same time, it is easy to clean same for maintaining an everclean state thereof, and more particularly, magnetized hexagonal water useful for human body can be obtained because the discharged cold water is magnetized by the magnetic force generated from the first and the second magnetic members.

Now, the water dispenser of a refrigerator according to the third embodiment of the present invention will be described.

First of all, it should be noted that, in case of the second embodiment, there has been a matter of concern where an accurate rectilinear motion of the operational shaft 40 might go wrong when the water dispenser is used for a long time because only the first and the second magnetic members 28 and 42 are used.

In other words, an accurate control can be difficult because the elastic member 24*a*, the operational shaft 40, the packing members 46*c* and the like are controlled by the first and the second magnetic members 28 and 42 according to a two-point control method.

Meanwhile, a detailed description of the water dispenser according to the third embodiment of the present invention will be omitted because schematic construction thereof is the same as that of the second embodiment, so that only the difference therebetween will be described.

Figure 8:
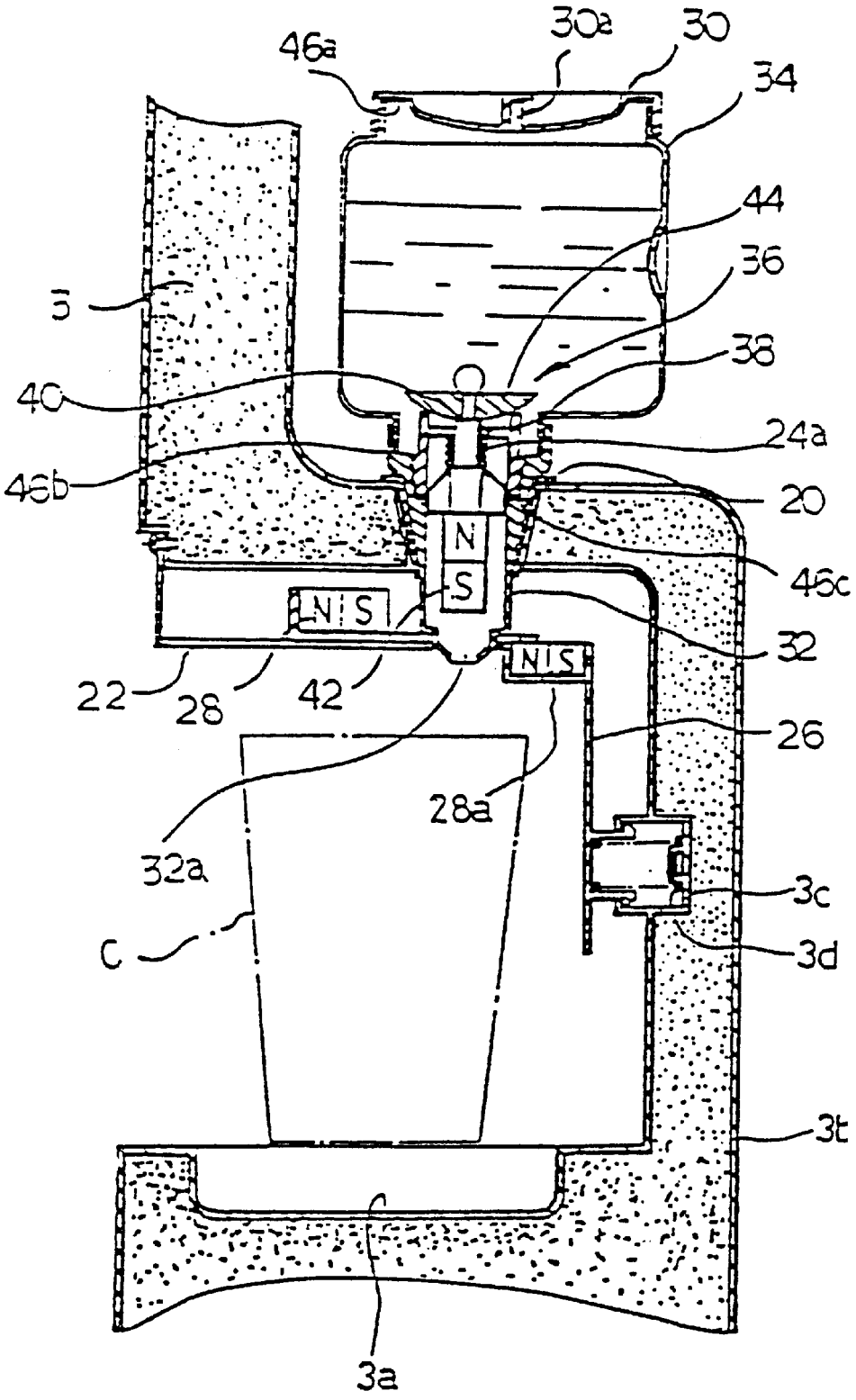
FIG. 8 is a sectional view for illustrating a water dispenser of a refrigerator according to a third embodiment of the present invention.

The water dispenser of a refrigerator according to the third embodiment of the present invention is attached at one side of the water discharge lever 26 with a third magnetic member 28*a*, as illustrated in FIG. 8.

The third magnetic member 28*a* is disposed with its polarity opposite to that of the first and the second magnetic members 28 and 42, and is so designed as to possess a less strong magnetic force than that of the first magnetic member 28.

In other words, the magnetic force at the third magnetic member 28*a* is good enough in strength thereof as to remove an error (by way of example, an amount to compensate for a clearance between the cold water pipe 38 and the valve plate 44 caused by a slight inclination of the operational shaft 40) generated during the rectilinear motion of the second magnetic member 42.

In other words, the strength of the magnetic force at the third magnetic member 28*a* should be within a scope of not causing an impediment to a reciprocating movement of the second magnetic member 42.

Now, an operational effect of the water dispenser of a refrigerator according to the third embodiment of the present invention will be described.

Figure 9:
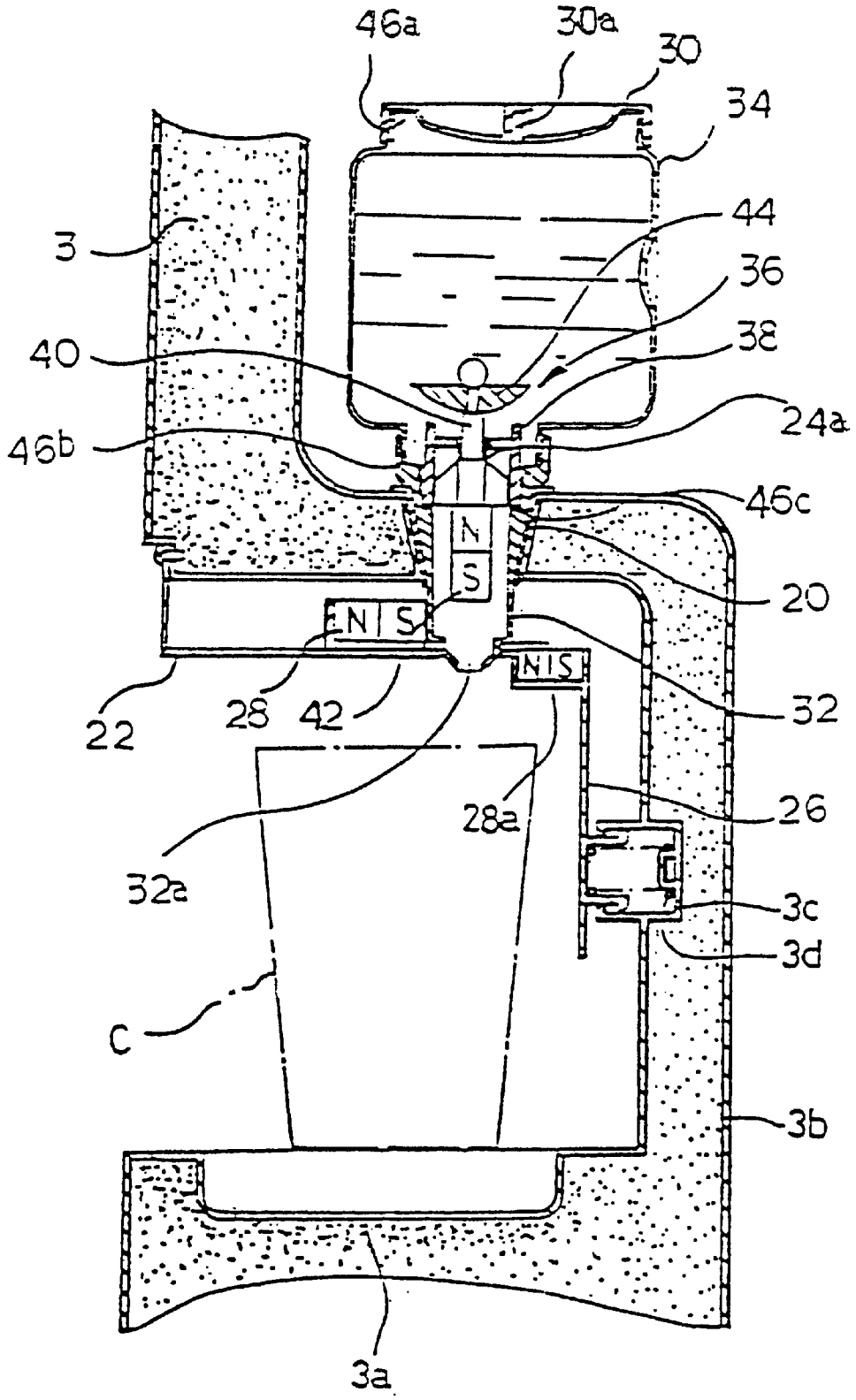
FIG. 9 is a sectional view for illustrating an operational state of the water dispenser illustrated in FIG. 8.

As shown in FIG. 9, once a pressure is applied to the water discharging lever 26, the first magnetic member 28 moves toward the second magnetic member 42.

The second magnetic member 42 is raised by the repulsive force generated from between the first magnetic member 28 and the second magnetic member 42.

At this time, the magnetic force of the third magnetic member 28*a* is applied to the second magnetic member 42 to enable same to perform an accurate rectilinear motion.

Accordingly, the water dispenser of a refrigerator according to the third embodiment of the present invention does not generate any errors even though the second magnetic member 42 repeats continuous up and down operations.

Now, the water dispenser of a refrigerator according to a fourth embodiment of the present invention will be described.

Figure 10:
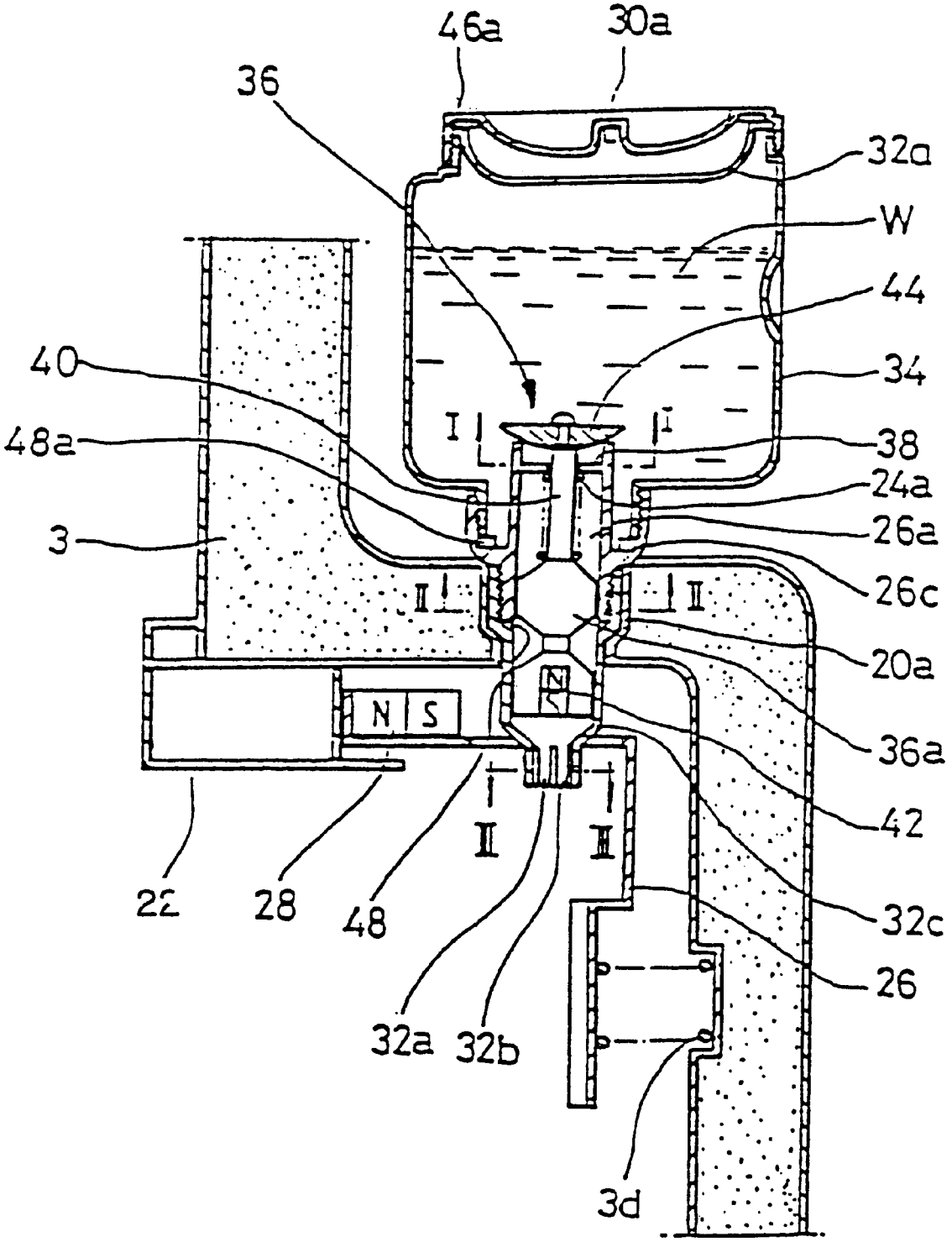
FIG. 10 is a sectional view for illustrating a water dispenser of a refrigerator according to a fourth embodiment of the present invention.

As illustrated in FIG. 10, the water dispenser of a refrigerator according to the fourth embodiment of the present invention is protrudingly disposed at an external side of the operational shaft 40 with a plurality of outwardly directed ribs 36*a* in order to maintain stability and accurate guide of the operational axes described in the aforementioned embodiments.

Figure 11:
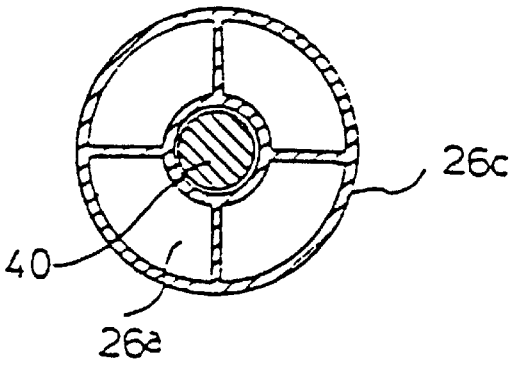
FIG. 11 is a horizontal sectional view taken along line II in FIG. 10.
Figure 12:
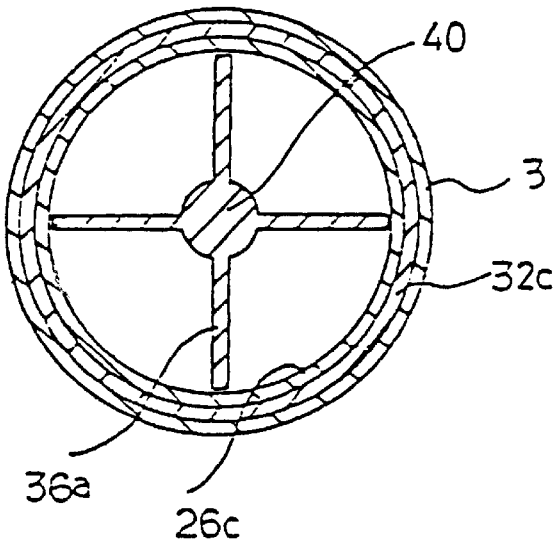
FIG. 12 is a horizontal sectional view taken along line II—II in FIG. 10.

The water storage vessel 34 is screwed thereunder to a lower cap 26*c* employing a cold water passage 26*a* for enabling circulation of the cold water (W). The lower cap 26*c* is screwed thereunder to a water discharge cap 32*c* having a water discharge outlet 32*a* at a tip end thereof, as illustrated in FIGS. 11 and 12.

Figure 13:
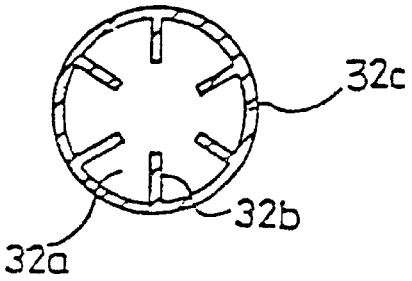
FIG. 13 is a horizontal sectional view taken along line III—III in FIG. 10.
Figure 14:
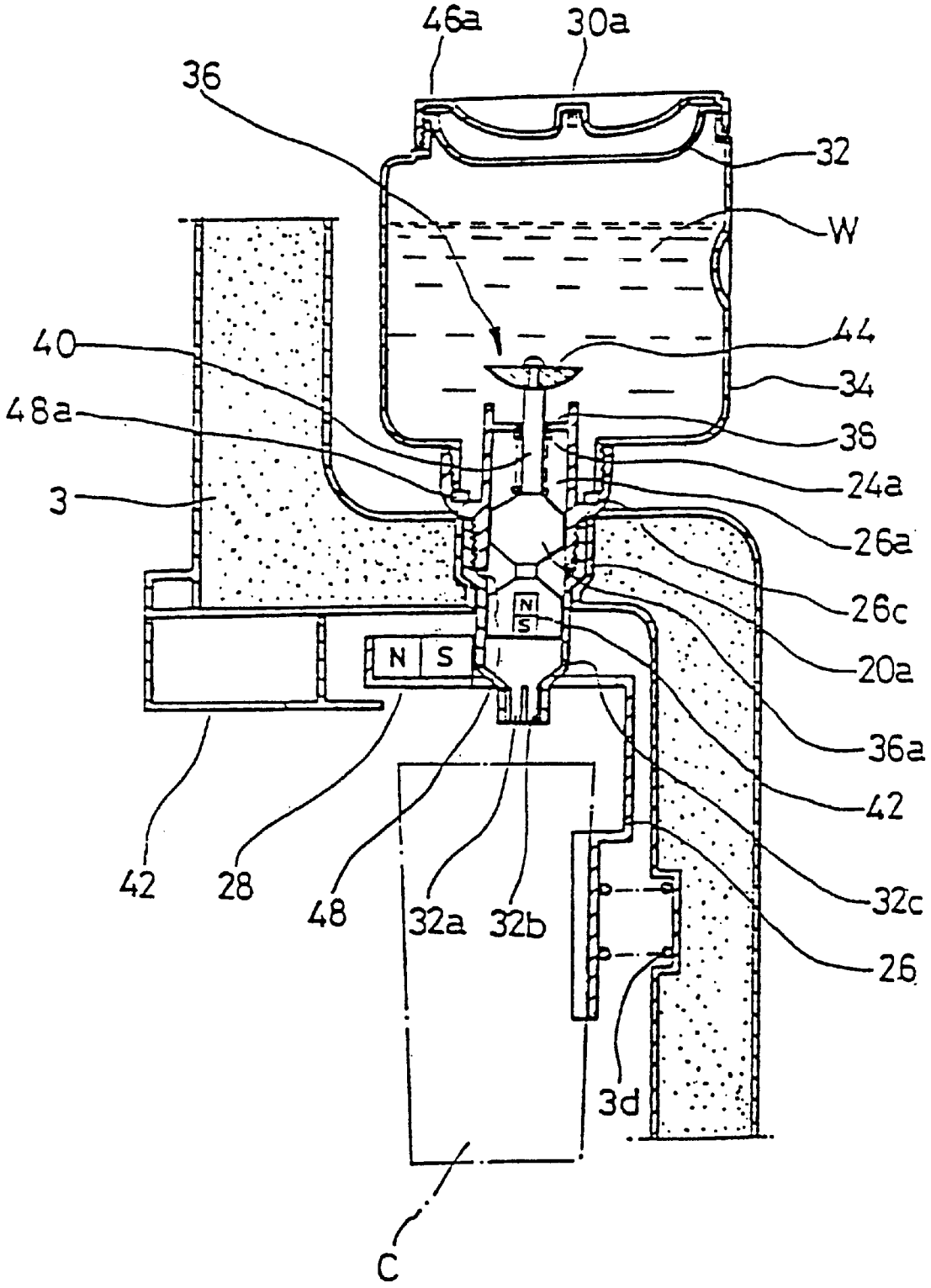
FIG. 14 is a sectional view for illustrating an operational state of the water dispenser illustrated in FIG. 10.

Furthermore, the water discharge outlet 32*a* is protrudingly formed therein, as shown in FIG. 13, with a plurality of guide protrusions 32*b* in order to guide flow of the cold water (W), so that the cold water (W) does not disperse in all directions.

Meanwhile, the lower cap 26*c* and the water discharge cap 32*c* are resiliently mounted therein with valve means 36 for being vertically operated to selectively discharge the cold water (W) in the water storage vessel 34.

The valve means 36 includes the operational shaft 40 for being resiliently disposed in the lower cap 26*c* by resilient member 24*a*, a valve plate 44 for being fixedly arranged at an upper end of the operational shaft 40 to thereby open and close the cold water passage 26*a* and a first magnetic member 28 for being mounted under the operational shaft 40. The operational shaft 40 is protrudingly formed at an external side thereof with a plurality of ribs 36*a*.

A guide member 22 fixedly provided under the refrigerating chamber door 3 is resiliently disposed therein by a spring 3*d* with the water discharge lever 26 for being horizontally and slidingly operated.

Furthermore, the water discharge lever 26 is mounted at an upper side thereof with a second magnetic member 42 for approaching the first magnetic member 28 according to the sliding operation to vertically lift the operational shaft 40.

A detailed description of structure and operational effect for the first and the second magnetic members 28 and 42 are omitted herein because it is similar to the aforementioned embodiments.

Meanwhile, unexplained reference numerals 48*a* and 48*b* are packing members for preventing leakage of the cold water (W).

Next, an operational effect of the water dispenser of a refrigerator according to the fourth embodiment of the present invention will be described.

First of all, the water storage vessel 34 storing a predetermined quantity of cold water (W) therein is mounted to a mounting part 20*a*, so that the cold water (W) in the water storage vessel 34 is not discharged.

Meanwhile, in case of discharging the cold water (W), a vessel (C) such as cup and the like is made to be placed under the water discharge outlet 32*a* and a force is applied to a water discharge lever 26 to allow same to be slidingly operated. The water discharge lever 26 is then forced to compress the spring 3*d* to slidingly and horizontally be operated, and at the same time, the second magnetic member 42 is moved to approach one side surface of the water discharge cap 32*c*.

At this time, a repulsive force is generated on the second magnetic member 42 and the first magnetic 28 because of the same polarity being approached thereto, so that the valve means 36 resiliently disposed within the lower cap 26*c* is force to be opened.

In other words, the operational shaft 40 compresses the resilient member 24*a* and is lifted upward by the repulsive force generated in accordance with the approach of the second magnetic member 42, and the valve plate 44 is raised along. with the operational shaft 40 to thereby detach the operational shaft 40 from the upper end of the lower cap 62, so that the cold water (W) in the water storage vessel 34 is infused into the cold water passage 56*a*.

The cold water (W) infused into the cold water passage 26*a* is discharged into the vessel (C) through the water discharge outlet 32*a* formed at a lower end of the water discharge cap 32*c*, which enables discharge of the cold water (w).

At this time, the cold water (w) discharged into the vessel (c) passes through the water discharge cap 32*c* to thereafter be magnetized by the magnetic force generated from the first and the second magnetic members 28 and 42, and at the same time, a ring structure of the cold water changes into a hexagonal ring structure. In other words, the cold water (w) becomes hexagonal water which is good for the health. The cold water (w) is also discharged on the straight by the plurality of guide protrusions 32*b* protrudingly formed on an inner periphery of the water discharge outlet 32*a* to thereby prevent same from being dispersed.

Meanwhile, when the force applied to the water discharge lever 26 is released, the lever 26 returns to an original state by way of the elastic force of the spring 3*d* and at the same time, the second magnetic member 42 is detached from the water discharge cap 32*c* to thereby lose the magnetic force generated from between the first magnetic member 28 and the second magnetic member 42. Accordingly, the operational shaft 40 is activated downward by the elastic force of the elastic member 24*a*, and , at the same time, the valve plate 44 is lowered to close the upper end of the cold water passage 26*a* and to thereby stop discharge of the cold water (w).

As mentioned above, there is an advantage in the fourth embodiment of the water dispenser of a refrigerator according to the present invention in that structure thereof is simple and assembly and dismantlement thereof is easy and cleaning thereto is bandy for maintaining the water dispenser at all times, and more particularly, the discharged cold water (w) is magnetized by the magnetic force of the first and the second magnetic members to thereby enable to obtain magnetized hexagonal water useful for the health of a human body.

Now, the water dispenser of a refrigerator according to a fifth embodiment of the present invention will be described.

A water dispenser of a refrigerator according to the fifth embodiment of the present invention uses magnetization means instead of the first magnetic member in the fourth embodiment.

Figure 15:
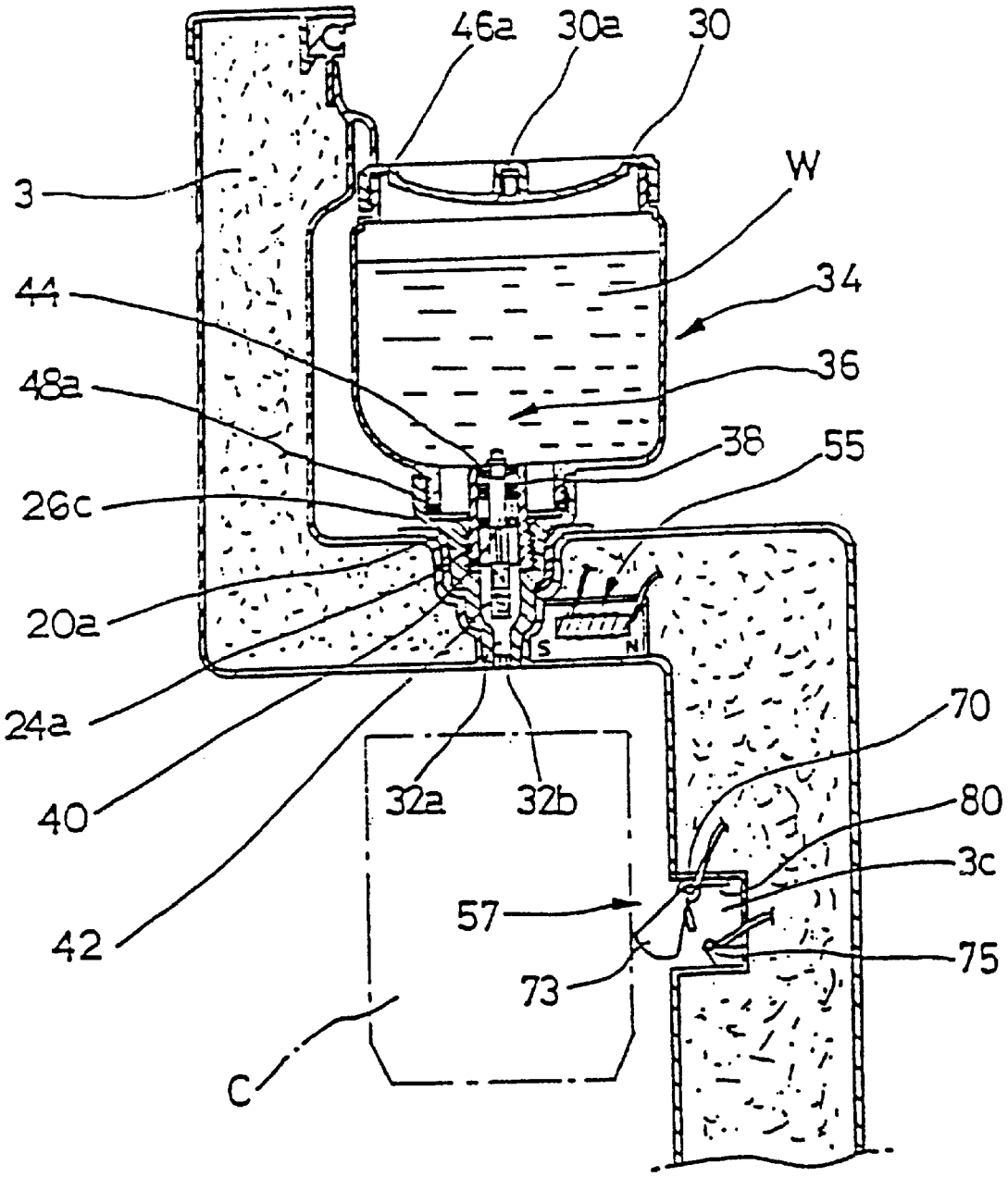
FIG. 15 is a sectional view for illustrating a water dispenser of a refrigerator according to a fifth embodiment of the present invention.

As illustrated in FIG. 15, the water dispenser of a refrigeration according to the fifth embodiment of the present invention is formed at an inner side of the refrigerating chambered 3 with a mountain part 20*a* for mounting the water storage vessel 34 thereto.

The mounting part 20*a* is releasably screwed to a lower cap 26*c* connected to the water storage vessel 34.

The water storage vessel 34 is the same in its structure as the above mentioned in the above embodiments, so that no further description thereof will be omitted.

Meanwhile, the refrigerator chamber door 3 is disposed at one side thereof with. magnetization means 55 having the same polarity as that of the second magnetic member 42 connected to the operational shaft 40.

The refrigerating chamber door 3 is formed at an external side thereof with a case guide groove 3*c* and at an inner side of the case guide groove 3*c* there is disposed manipulating means 57.

The manipulating means 57 is a push switch so constructed as to be connected to and detached from electrical contacts 70 and 75, and to be restored by an elastic member 80 according to movement of the swing member 73.

Now, an operational effect of the water dispenser of a refrigerator according to the fifth embodiment of the present invention thus constructed will be described.

Figure 16:
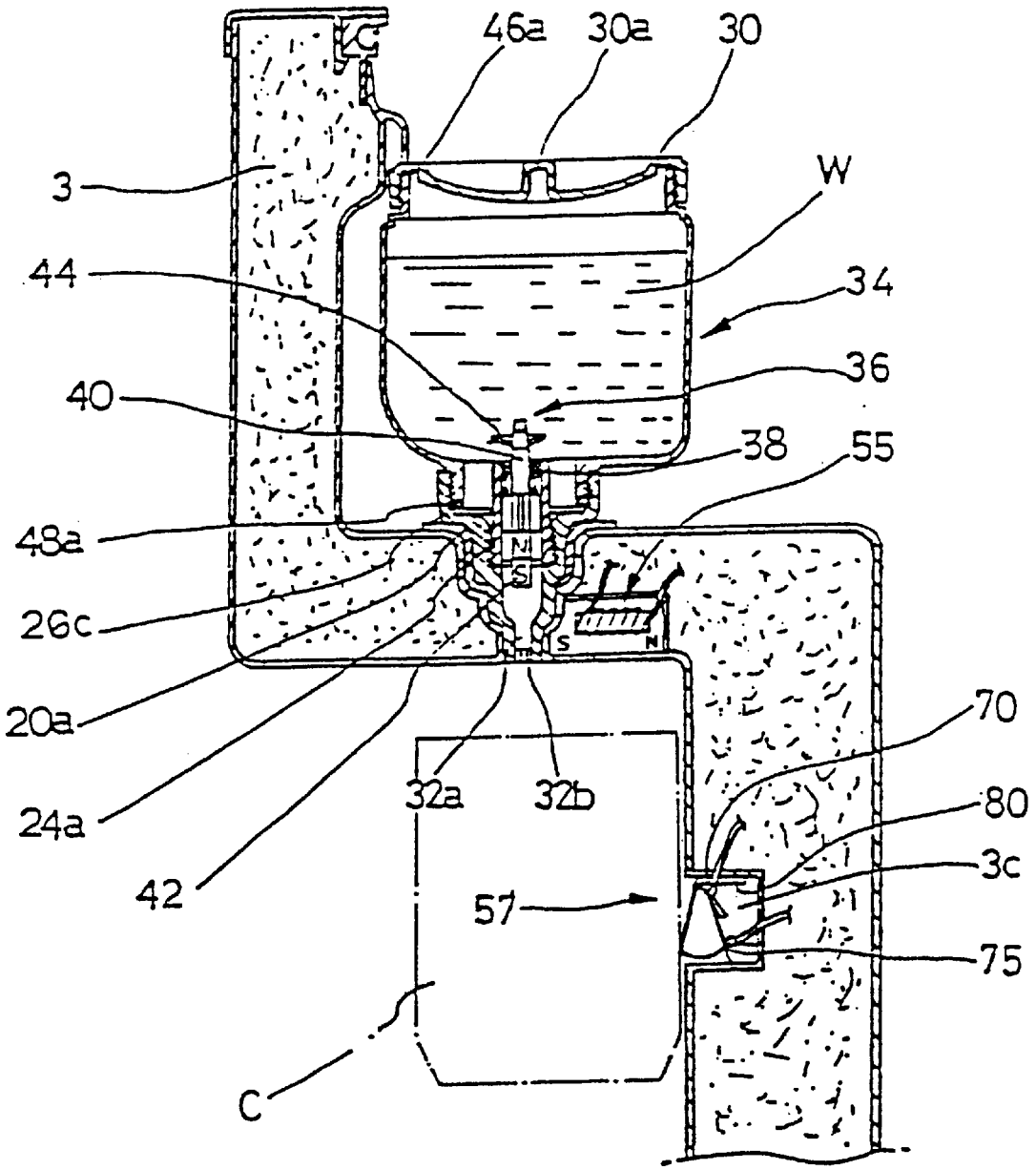
FIG. 16 is a sectional view for illustrating an operational state of the water dispenser illustrated in FIG. 15.

Referring to FIG. 16, when a user wants to discharge the cold water (W) from the water storage vessel 34, a vessel (C) is positioned underneath a water discharge outlet 32*a*. Then the vessel (C) is pushed forward to thereby cause the swing member 73 to contact the electrical contacts 70 and 75.

At this time, the magnetization means 55 is applied by electric power to thereby perform a role of an electromagnet and to supply a repulsive force to the second magnetic member 42.

The operational shaft 40 connected to the second magnetic member 42 serves to push upward the valve plate 44 disposed within the water storage vessel 34 according to the repulsive force.

In other words, a direct current flows in the magnetization means 55, whereby an tip end of the second magnetic member 42 and another tip end of the magnetization means 55 situated nearby repulse each other due to the same polarity thereon.

When the valve plate 44 is raised, the cold water (w) stored in the water storage vessel 34 is infused into a cold water pipe 38 to thereafter be discharged sequentially through the lower cap 26*c* and the water discharge outlet 32*a* for water dispensing.

Furthermore, the water discharge outlet 32*a* is formed at an inner side thereof with a guide protrusion 32*b*, so that the cold water (w) is not dispersed, only to be easily contained in the vessel (c)

Meanwhile, when the vessel (c) which has been pressing the swing member 73 is removed, the swing member 73 returns to an original state thereof by way of restoration force of the elastic member 80, as illustrated in FIG. 15, hereby causing the electrical contacts 70 and 75 to be separated therefrom.

At this time, the magnetization means 55 is stopped of power supply to thereby lose a magnetizing force, so that the operational shaft 40 is lifted downward.

In other words,the valve plate 44 serves to close the cold water pipe 38 to thereby cause the cold water (w) in the water storage vessel 34 not to be discharged any more.

Accordingly, there is an advantage in the water dispenser of a refrigerator according to the fifth embodiment of the present invention, in that a valve plate can be controlled in opening and closing thereof by way of magnetization means and magnetic member, thereby increasing reliability, thereof for prevention of erroneous operation and reducing manufacturing cost thereof because of less number of parts involved for manufacturing thereof compared with the conventional water dispenser.

As apparent from the foregoing, although the present invention has described about five embodiments, those skilled in the art will appreciate that various modifications, additions and substitution are possible, with departing from the scope and the spirit of the invention, as disclosed in the accompanying claims, and it should be also noted that anything that serves to open and close the valve plate by activation of the operational axis according to electromagnet and magnetization means belong to the scope of the present invention as disclosed in the claims.

What is claimed is:

1. A refrigerator comprising:

a housing;

a door swingably mounted on the housing;

a cylinder mounted on and projecting through the door and including an external end for dispensing water, and an internal end having a mounting part;

a water storage vessel mounted on an inner side of the door and connected to the mounting part, whereby the vessel is able to supply water to the cylinder;

a slide member slidably disposed within the cylinder;

a first magnetic member disposed at one end of the slide member;

an operational shaft mounted for up and down movement at a lower end of the water storage vessel for opening the water storage vessel in response to upward movement of the shaft;

a second magnetic member mounted on the shaft for raising the shaft in response to the first magnetic member being moved into proximity to the second magnetic member; and a manually actuable water discharge lever operably connected to the slide member for displacing the slide member inwardly and causing the first magnetic member to move into the proximity of the second magnetic member.

2. The refrigerator according to claim 1 wherein the slide member includes a first valve plate for opening and closing an interior of the cylinder.

3. The refrigerator according to claim 1 wherein the water storage vessel includes a lid and a filter disposed beneath the lid.

4. The refrigerator according to claim 1 wherein the first and second magnetic members include mutually facing portions of the same polarity, whereby the second magnetic member is repelled by the first magnetic member when the first magnetic member becomes disposed in the proximity of the second magnetic member.

5. A refrigerator comprising:

a housing;

a door swingably mounted on the housing;

a water storage vessel mounted on an inner side of the door and including a lid with an air hole, and a lower cap releasably disposed at a lower side of the vessel;

a guide member mounted on an exterior side of the door;

a manually actuable water discharge lever disposed for movement on the guide member;

a first magnetic member operably disposed on the lever to be moved therewith;

a valve plate movably disposed at an outlet of the water storage vessel for opening and closing the outlet; and a second magnetic member connected to the valve plate for opening the valve plate in response to the first magnetic member being moved into the proximity of the second valve member.

6. The refrigerator according to claim 5 wherein the first and second valve members face each other with the same polarity.

7. The refrigerator according to claim 5 wherein the lower cap has a water pipe disposed therein; an operational shaft movably disposed within the water pipe; the valve plate disposed at an upper end of the shaft for opening and closing the water pipe; the second magnetic member disposed at a lower end of the shaft.

8. The refrigerator according to claim 7 further including a resilient member biasing the shaft and valve plate to a position wherein the valve plate closes the water pipe, the second magnetic member arranged to be repelled by the first valve member to move the shaft against a bias of the resilient member.

9. The refrigerator according to claim 5 further including a third magnetic member arranged to promote movement of the first magnetic into the proximity of the second magnetic member.

10. The refrigerator according to claim 9 wherein the third magnetic member is arranged to magnetically attract the first magnetic member.

11. The refrigerator according to claim 10 wherein the third magnetic member has weaker magnetic strength than, the first magnetic member.

12. A refrigerator comprising:

a housing;

a door swingably mounted to the housing;

a water storage vessel mounted on an interior side of the door and including a lid with an air hole and a lower cap removably disposed at a lower side of the storage vessel;

a water discharge cap releasably coupled to the lower cap and including a water discharge outlet at a lower side thereof;

a manually actuable water discharge lever arranged on an exterior side of the door;

a first magnetic member mounted on the lever for movement therewith;

a valve plate arranged to open and close the water discharge outlet; and a second magnetic member operably connected to the valve plate to raise and open the valve plate in response to the first magnetic member being moved into the proximity of the second magnetic member.

13. The refrigerator according to claim 12 wherein the water discharge cap includes a plurality of radially inwardly projecting guide protrusions at the water discharge outlet for controlling a discharge direction of water from the water discharge outlet.

14. The refrigerator according to claim 12 wherein the first and second magnetic Members face each other with the same polarity.

15. The refrigerator according to claim 12 further including a vertical shaft having the valve plate disposed at an upper end thereof and carrying the second magnetic member.

16. The refrigerator according to claim 15 wherein a lower end of the shaft includes a plurality of radially outwardly projecting ribs.

17. The refrigerator according to claim 16 wherein the second magnetic member is mounted on one of the ribs.

18. The refrigerator according to claim 17 further including a resilient member biasing the valve plate to a closed position, the second magnetic member arranged to be repelled by the first magnetic member for opening the valve plate against a bias of the resilient member.

19. The refrigerator according to claim 12 wherein the first and second magnetic members comprise permanent magnets.

20. A refrigerator comprising:

a housing;

a door swingably mounted on the housing;

a water storage vessel mounted on an interior side of the door;

a movable operational shaft having a valve plate connected thereto for opening and closing the water storage vessel in response to movement of the shaft;

a magnetic member mounted on the shaft;

magnetization means mounted on the door adjacent the shaft for being selectively magnetizable to move the shaft; and a manipulation means manually operable by a user for causing the magnetization means to be magnetized.

21. The refrigerator according to claim 20 wherein the magnetization means comprises an electromagnet.

22. The refrigerator according to claim 21 wherein the manipulating means comprises a guide groove disposed in the door, a swing member movably mounted in the guide groove, electronic contacts for being opened and closed by the swing member and for energizing the electromagnet when closed, and a resilient member for biasing the swing member to a position wherein the electrical contacts are open.

* * * * *